US005163223A

United States Patent [19]

Wurster

[11] Patent Number: 5,163,223

[45] Date of Patent: Nov. 17, 1992

[54] PROCESS FOR MAKING AN ELECTRICAL CONNECTOR PIN HAVING FULLY ROUNDED CONTACT SURFACES

[75] Inventor: Walter W. Wurster, West Covina, Calif.

[73] Assignee: Custom Stamping, Inc., Covina, Calif.

[21] Appl. No.: 748,093

[22] Filed: Aug. 21, 1991

[51] Int. Cl.[5] ..... H01R 43/16

[52] U.S. Cl. ..... 29/874; 83/51

[58] Field of Search ..... 29/874, 882; 72/327; 83/51; 439/851, 888; 428/929

[56] References Cited

U.S. PATENT DOCUMENTS

| | | | |
|---|---|---|---|
| 2,508,758 | 5/1950 | Hollerith . | |
| 3,878,746 | 4/1975 | Carmeli . | |
| 4,362,078 | 12/1982 | Ohnishi et al. . | |
| 4,477,537 | 10/1984 | Blase et al. . | |
| 4,641,514 | 2/1987 | Rozmus | 29/874 |
| 4,798,075 | 1/1989 | Killian et al. | 72/327 |

*Primary Examiner*—P. W. Echols

*Attorney, Agent, or Firm*—Spensley Horn Jubas & Lubitz

[57] ABSTRACT

Electrical connector pins capable of providing high Hertzian stresses are made by a progressive punch press process that forms, in two stages, opposed, substantially fully rounded contact surfaces on the pins.

3 Claims, 3 Drawing Sheets

PROCESS FOR MAKING AN ELECTRICAL CONNECTOR PIN HAVING FULLY ROUNDED CONTACT SURFACES

FIELD OF THE INVENTION

This invention relates generally to electrical connectors and more specifically to a connector pin having contact surfaces configured to provide high Hertzian stress and consequently low and stable contact resistance. The invention also relates to a progressive or multi-stage punch press process for fabricating such pins.

BACKGROUND OF THE INVENTION

Because of the trend toward larger scale circuit integration and higher pin-count connectors, today's electronic circuits are increasingly characterized by lower electrical energy levels. Accordingly, mechanical energy rather than electrical energy must be relied upon to pierce the insulative surface films of the contact elements of connectors. A contact system ultimately derives its mechanical energy from a flexible contact element, like that found in a multi-finger clip, bearing against a mating element such as a post or pin typically having a square cross section.

As pointed out by Kantner and Hobgood in their paper, *Hertz Stress as an Indicator of Connector Reliability*, appearing in Connection Technology, March, 1989, pages 14–22, current flow in metallic electrical contacts is established through minute metal-to-metal contact sites formed as a result of Hertzian stress imposed on the contact element surfaces. The Hertzian stress (measured, for example, in psi) producing the contact sites is a function of not only the normal force applied by the contact elements by virtue of their spring properties, but also of the geometry of the contact elements and the modulus of elasticity of the contact material. For a given normal force, contact element geometries presenting smaller areas provide higher forces per unit area. Such higher stresses facilitate the mechanical penetration of surface films, resulting in the desired low and stable contact resistance. Accordingly, Hertzian stress, rather than normal force, is a key criterion indicative of contact performance, and higher Hertz stress connectors are to be preferred.

It is known that a highly reliable connector mating surface geometry is that which produces a "fine point" contact. Such a contact results, for example, from bringing together two rounded surfaces (sometimes referred to as a "crossed rod" contact configuration) and, not surprisingly, connectors employing such contact element geometries exhibit extremely high Hertzian stresses.

Accordingly, in the case of square connector posts or pins in which contact with mating elements is established through two opposing surfaces of the pin, it is desirable to fully round the opposing contact surfaces. However, existing fabrication processes impose certain limitations on the pin surface geometries that can be formed economically. For example, the mating contact surfaces of pins produced by existing punch press processes are not fully rounded. Instead, central flats remain on the opposed contacting surfaces of the pin which reduce Hertzian stresses and hence the reliability of the electrical connection afforded by the final product.

Thus, it is an overall object of the present invention to provide an electrical connector pin configured for high Hertzian stresses and low and stable contact resistance during use thereof.

It is a more specific object of the present invention to provide a connector pin having opposing contact or mating surfaces that are fully rounded.

It is yet another overall object of the present invention to provide a metal stamping process for fabricating connector pins that have opposed surfaces that are fully rounded.

Another object of the present invention is to provide an electrical connector pin that is a product of the aforementioned process.

SUMMARY OF THE INVENTION

Pursuant to a specific example of a process for making electrical connector pins having a configuration in accordance with the invention, sheet metal stock having opposed, upper and lower surfaces is positioned between a first punch and a first die of a punch press. The first die, which is adjacent the lower surface of the stock, has an opening in alignment with the first punch. The first punch may be substantially the same size as, or slightly smaller than, the corresponding opening in the first die.

Next, the first punch is advanced toward the first die a sufficient distance to penetrate the upper surface of the stock, but not so far as to break or fracture the stock. The first punch thereby forms a recess in the upper surface of the stock and an embossment projecting from the second surface into the die opening. As a result of this step, there is formed on the embossment a substantially fully rounded outer surface.

The sheet metal stock is then indexed and positioned between a second punch and a second die which are inverted relative to the first punch and die. Thus, the second punch is adjacent the lower surface of the stock and the second die is adjacent the upper surface of the stock. The sheet metal stock is so indexed that the second punch and second die are positioned in alignment with the recess and embossment formed by the first punch and die. The second die includes an opening having a size smaller than that of the first punch and clearance is provided between the second punch and second die.

The second punch is advanced toward the second die to completely cut the part from the sheet metal stock, and this action forms a substantially fully rounded outer surface on the pin opposite the first mentioned rounded outer surface.

Thus formed is an electrical connector pin providing high Hertzian stress and low and stable contact resistance during use. More specifically, the pin has opposed, substantially fully rounded contact surfaces capable of providing a "fine point" contact with an appropriately shaped receptacle contact element. The other pair of opposed surfaces on the pin are substantially flat and parallel, and the dimension across the opposed flat surfaces is substantially equal to that across the fully rounded surfaces.

The surfaces of the pin provided by the process of the invention have a smooth finish, a factor that contributes to low insertion and withdrawal forces. Moreover, since the electrical contact site is confined to a small central region at the top of the rounded surfaces, gold plating can be selectively, and therefore economically, applied to those surfaces.

BRIEF DESCRIPTION OF THE DRAWINGS

Further objects, features and advantages of the invention will become apparent from the detailed description of the preferred embodiments when read in conjunction with the accompanying drawings in which.

DETAILED DESCRIPTION OF THE PREFERRED EMBODIMENTS

Figure 1:
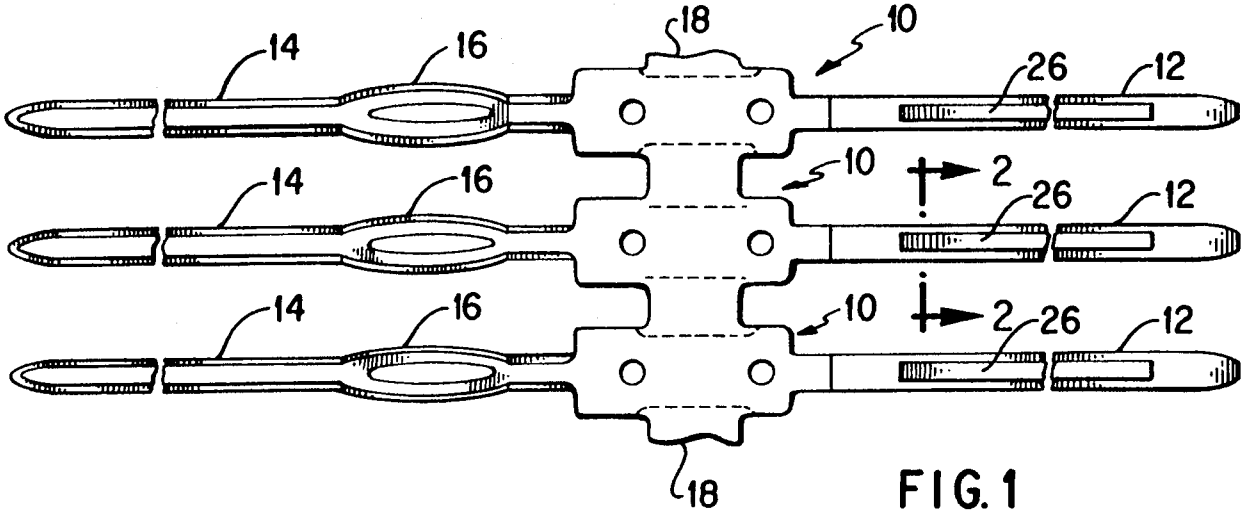
FIG. 1 is a top plan view of a segment of a strip of typical contact assemblies formed by a progressive punch press and including pins in accordance with the invention.

Referring first to FIG. 1, there is shown, by way of example, a plurality of typical contact assemblies 10 each having at one end a generally square post or pin 12 in accordance with the invention and designed to be received by a socket or clip (not shown). Each contact assembly 10 further has a contact element 14 opposite the pin 12. The contact element 14 has a bifurcated, compliant sectoin 16 adapted to be press fit into a plated-through hole in a printed circuit board or the like.

The contact assemblies 10 are stamped from an elongated metal strip processed by a progressive or multi-stage punch press. As the strip is advanced stepwise or indexed through the press, the strip is punched into a plurality of patterned blanks which are then progressively formed into the final contact assembly configuration. The contact assemblies 10 are joined by a web 18 thereby allowing the strip of formed contact assemblies to be wound on a reel to facilitate their subsequent automated separation and installation.

It will be understood that the present invention relates to the configuration of the pin 12 and to the process by which it is fabricated, and it will be evident to those skilled in the art that the invention described herein may be applied to contact assemblies or connector elements of any kind and is not limited to the exemplary contact assembly 10 shown in FIG. 1.

Figure 2:
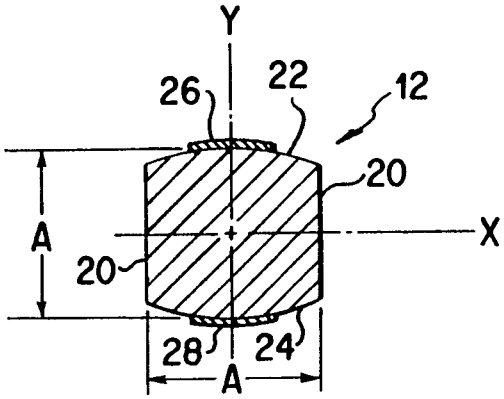
FIG. 2 is a cross section of one of the pins shown in FIG. 1 as seen along the line 2—2.

As best seen in FIG. 2, each contact pin 12 has a generally square cross section whose side dimension A may be about 0.020 inch (0.51 mm) in accordance with one practical example. The pin 12 has substantially flat, parallel side surfaces 20 and opposed, smooth contact surfaces 22 and 24 which are fully rounded so as to provide a high Hertz stress, low resistance electrical connection, as already explained. By way of example, for a pin having 0.020 inch sides, the radius of curvature of the rounded surfaces 22 and 24 may be about 0.031 inch (0.80 mm). Further, the pin 12 is symmetrical about each of the central orthogonal axes X and Y.

Since in the use of the connector pin 12, the electrical contact area is confined to a site lying substantially on a central, longitudinal line extending along the top of the rounded surfaces 22 and 24, the pin 12 may be selectively and economically gold plated only where it is needed. Thus, gold plating can be limited, pursuant to one example, to narrow, longitudinal strips 26 and 28 0.010 inch wide centered on the rounded surfaces 22 and 24, as shown in FIGS. 1 and 2.

Figure 3:
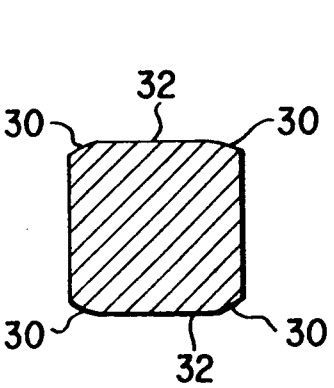
FIG. 3 (PRIOR ART)
FIG. 3 is a cross section view, like that of FIG. 2, showing the configuration of a pin in accordance with the prior art.

The cross section of the pin in accordance with the invention (FIG. 2) may be compared with the configuration of a prior art pin shown in FIG. 3. It will be seen that the prior pin has opposing contact surfaces having rounded edges 30 separated by a central flat portion 32. This configuration tends to provide lower Hertzian stresses and therefore a less than optimum electrical contact between the pin and mating contact elements. The contact configuration of FIG. 3 is produced, for example, by existing punch presses which, although they can be designed to reduce the length of the central flat 32, cannot eliminate it entirely.

In FIGS. 4–7, there is shown schematically the portions of a progressive punch press which form the pins 12 having the smooth, fully rounded opposing contact surfaces 22 and 24, and the flat, parallel side surfaces 20 in accordance with the configuration of FIG. 2. For the sake of clarity, such other components of the punch press as strippers, hydraulic actuators, guide pins, and so forth, are not shown. Such components are, of course, well known in the art and need not be elaborated upon here.

Figure 4:
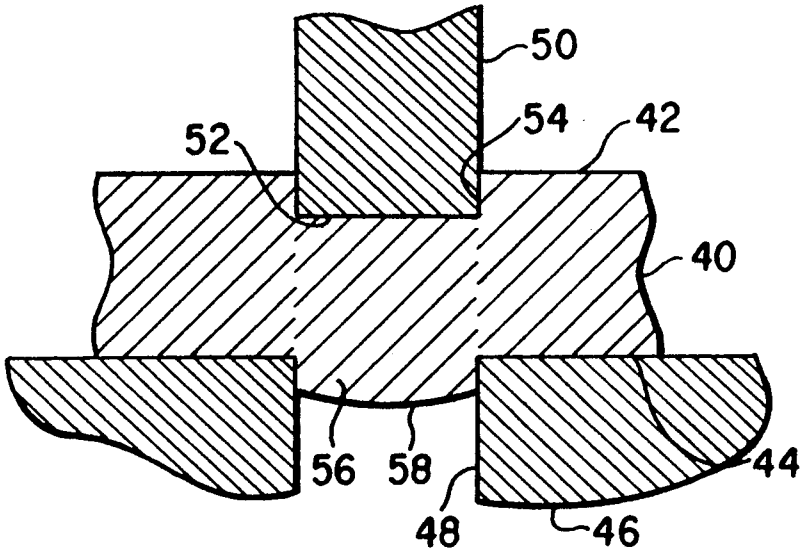

FIG. 4 shows a portion of a first station of the punch press. The sheet metal stock 40 from which the contact assemblies 10 are fabricated is in the form of a strip having an upper surface 42 and a lower surface 44. The first station shown in FIG. 4 includes a first punch and die assembly having a die 46 for engaging the lower surface 44 of the sheet metal stock. The die 46 has a die opening 48 having a width larger than the dimension across the flat sides 20 of the finished pin 12.

The first punch and die assembly also includes a punch 50 adjacent the upper surface 42 of the stock and aligned with the opening 48 in the die 46. The punch 50 has a width substantially equal to that of the die opening 48 and includes a substantially flat working surface 52. Alternatively, the size of the punch 50 may be slightly smaller (for example, by about 0.001 inch) than the die opening 48.

FIG. 4 shows the relative positions of the first punch 50 and the first die 46 upon completion of a machine stroke. The punch 50 has penetrated the upper surface 42 of the sheet metal to a depth sufficient to force a portion of the sheet metal into the die opening 48. The punch 50 thus forms a recess 54 in the upper surface of the stock; it does not advance far enough, however, to break or fracture the sheet metal so that only a partial blanking operation is performed at the first station. It will be seen that the embossment 56 that projects into the die opening 48 has a substantially fully rounded, convex outer surface 58.

Figure 5:
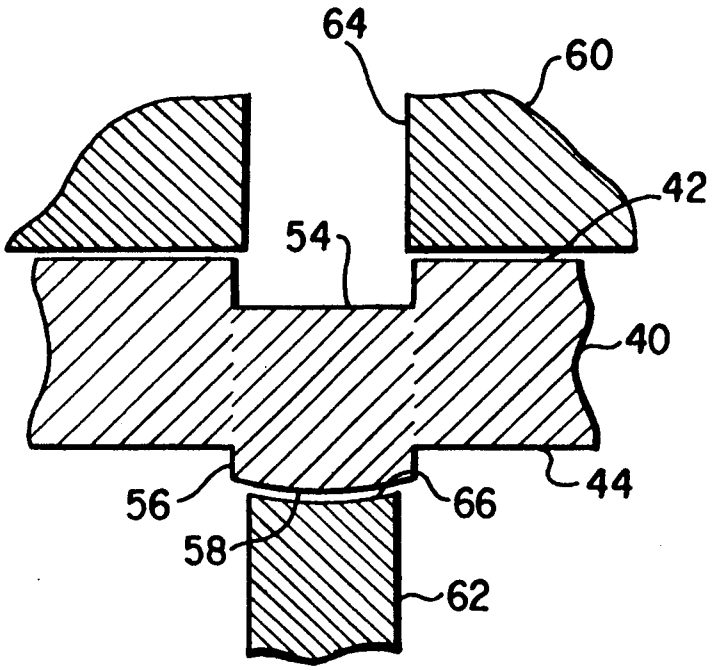
FIGS. 4–7 are end elevation views, in cross section, showing in simplified form portions of a progressive or multi-stage punching press for fabricating electrical connector pins in accordance with the present invention.
Figure 7:
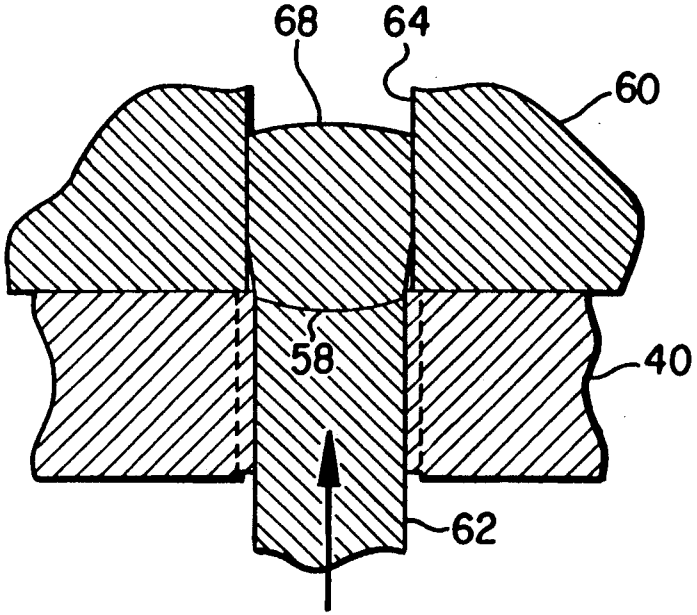
Figure 6:
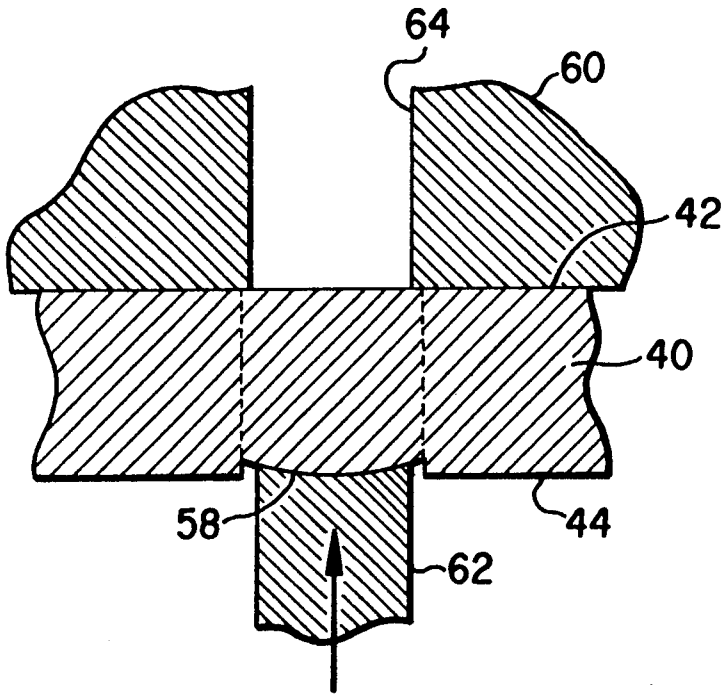

As is well known, in a progressive punch press the stock is indexed from station to station and FIGS. 5, 6 and 7 depict the sequence of operations which take place at a second station of the press. As shown in FIG. 5, the second station includes a second punch and die assembly that is inverted relative to the punch and die assembly at the first station. More specifically, the second punch and die assembly, shown in its rest position in FIG. 5, includes a die 60 disposed over the upper surface 42 of the stock 40 workpiece and a punch 62 positioned adjacent the lower surface 44. The die 60 includes a die opening 64 in alignment with the punch 62. The stock is positioned at the second station so that the punch 62 and die opening 64 are centered on the recess 54 and projecting embossment 56 formed in the stock as a result of the operation at the first station.

The opening 64 in the die 60 has a shape geometrically similar to but smaller than the size of the opening 48 in the first die 46. More specifically, the opening 64 has a width that is less than that of the opening 48 in the first die 46 and equal to the width across the flat sides 20 of the final pin 12. The punch 62, in turn, has a width somewhat less than that of the die opening 64 to provide appropriate clearance. The determination of such clearance, based on such factors as metal composition and thickness, is well known in the art.

The punch 62 has a working surface 66 that is concave, the configuration of which substantially matches the curvature of the fully rounded surface 58 on the embossment 56.

FIGS. 6 and 7 show the completion of the blanking process as the second punch 62 is advanced toward the second die 60. This operation results in a second, fully rounded surface 68, opposed to the first rounded surface 58, as the sheet metal is forced by the advancing punch into the die opening 64. It has been found that the curvatures of the opposed surfaces 58 and 68 thus formed are substantially equal and symmetrical and result in the smooth, fully rounded contact surface configurations desired in the end product.

It will be obvious to those skilled in the art that many changes and modifications in the preferred embodiments of the invention can be made without departing from the scope of the invention. Accordingly, the scope of the invention is intended to be limited only by that of the appended claims.

What is claimed is:

1. A process of making electrical connector contact elements from sheet metal stock having opposed first and second surfaces, the method comprising the steps of:

positioning the sheet metal stock between a first punch adjacent the first surface of the stock and a first die adjacent the second surface of the stock, the first punch having a predetermined size and shape and the first die having an opening in alignment with and of substantially the same shape as the first punch;

advancing the first punch toward the first die a sufficient distance to penetrate but not to fracture the sheet metal stock, the first punch thereby forming a recess in the first surface of the stock and an embossment projecting from the second surface into the die opening, the embossment having a substantially fully rounded outer surface;

removing the sheet metal stock from the first punch and first die;

positioning the sheet metal stock between a second punch and a second die, the second punch being adjacent the second surface of the stock and the second die being adjacent the first surface of the stock, the second punch and second die being positioned in alignment with the recess and embossment formed by the first punch and first die, the second die including an opening having a shape geometrically similar to but smaller than said predetermined shape and size, clearance being provided between said second punch and said second die; and advancing the second punch toward the second die to cut the part from the sheet metal stock, the action of the second punch and second die forming a substantially fully rounded outer surface on the part opposite the first mentioned rounded surface.

2. A process, as set forth in claim 1, in which:

the second punch has a working face configured to substantially match the substantially full rounded outer surface of the embossment.

3. A process, as set forth in claim 1, in which:

the first punch is slightly smaller than the opening in the first die.

* * * * *